US007628885B2

(12) United States Patent
Hübinette et al.

(10) Patent No.: US 7,628,885 B2
(45) Date of Patent: Dec. 8, 2009

(54) UNCOATED PAPERBOARD FOR PACKAGES

(75) Inventors: Mats Hübinette, Gävle (SE); Rein Aksberg, Gävle (SE); Sven Håkansson, Furuvik (SE)

(73) Assignee: Korsnas AB (PUBL.), Gavle (SE)

( * ) Notice: Subject to any disclaimer, the term of this patent is extended or adjusted under 35 U.S.C. 154(b) by 646 days.

(21) Appl. No.: 10/486,367

(22) PCT Filed: Aug. 30, 2002

(86) PCT No.: PCT/SE02/01547

§ 371 (c)(1),
(2), (4) Date: Mar. 2, 2004

(87) PCT Pub. No.: WO03/021040

PCT Pub. Date: Mar. 13, 2003

(65) Prior Publication Data

US 2004/0234802 A1 Nov. 25, 2004

(30) Foreign Application Priority Data

Sep. 5, 2001 (SE) ..... 0102941

(51) Int. Cl.
*D21H 21/16* (2006.01)
*D21H 27/30* (2006.01)
*B32B 29/00* (2006.01)

(52) U.S. Cl. ..... 162/123; 162/127; 162/158; 162/205; 428/172; 428/34.7; 206/524.1; 206/216

(58) Field of Classification Search ..... 162/123, 162/125–129, 204–207, 135, 158, 179; 428/537.5, 428/535, 608, 34.2, 156, 172, 34.1; 422/26; 206/524.1, 524.6, 216
See application file for complete search history.

(56) References Cited

U.S. PATENT DOCUMENTS

| | | | | | |
|---|---|---|---|---|---|
| 4,749,445 | A | * | 6/1988 | Vreeland | 162/206 |
| 5,836,242 | A | * | 11/1998 | Aberg | 100/327 |
| 5,876,562 | A | | 3/1999 | Johansson | |
| 5,876,815 | A | * | 3/1999 | Sandstrom et al. | 428/36.8 |
| 6,022,448 | A | * | 2/2000 | Eriksson et al. | 162/123 |
| 6,177,048 | B1 | | 1/2001 | Lagerstedt | |
| 6,379,497 | B1 | * | 4/2002 | Sandstrom et al. | 162/123 |
| 6,551,454 | B1 | * | 4/2003 | Ewens et al. | 162/119 |
| 2004/0234802 | A1 | * | 11/2004 | Hubinette et al. | 428/535 |
| 2007/0044929 | A1 | * | 3/2007 | Mohan et al. | 162/158 |
| 2007/0169902 | A1 | * | 7/2007 | Brelsford et al. | 162/135 |

FOREIGN PATENT DOCUMENTS

| | | | | |
|---|---|---|---|---|
| EP | 0 292 975 | A1 | | 11/1988 |
| SE | 502 090 | C2 | | 8/1995 |
| SE | 511 954 | C2 | | 12/1999 |
| WO | WO 0129316 | A1 | * | 4/2001 |
| WO | WO 03021040 | | * | 3/2003 |

OTHER PUBLICATIONS

K. Bottorff, AKD sizing mechanism: a more definitive description, Apr. 1994, Tappi Journal, vol. 77, No. 4, pp. 105-116.*

Reynolds, Walter F. "The Sizing of Paper," 1989, TAPPI Press, Second Edition, pp. 18-19.*

C.F. Baker, "The fundamentals of papermaking materials: transactions of the 11$^{th}$ Fundamental Research Symposium in, held at Cambridge", Leatherhead: Pira International, Sep. 1997, vol. 1, p. 210, 2$^{nd}$ paragraph and p. 234, text & Figure 8.

* cited by examiner

*Primary Examiner*—José A Fortuna
(74) *Attorney, Agent, or Firm*—Bacon & Thomas, PLLC

(57) ABSTRACT

An uncoated paperboard for packages composed of one or more layers with a top layer of bleached kraft pulp having a gloss value of 15-50% measured according to Tappi T480, a minimal gloss variation (a coefficient of variation in the wavelength regions 3-30 mm of less than 5%), and a surface roughness (PPS-10) of 2-5 μmm measured according to ISO 8791-4, wherein the paperboard has a density in the range of 700 to 850 kg/m$^3$ and is hydrophobic from a sizing agent treatment of each layer, is described. A package comprising the paperboard is suitable for co-sterilization of the package and its contents.

19 Claims, No Drawings

UNCOATED PAPERBOARD FOR PACKAGES

CROSS-REFERENCE TO RELATED APPLICATIONS

The present application is the U.S. national phase of international application number PCT/SE02/01547.

The present invention relates to a new quality of uncoated board for packages with a top layer of bleached kraft pulp. The characteristic features of the new quality are a superior resistance towards water penetration in addition to a low surface roughness, high gloss and minimal gloss variation. The paperboard of the invention has a top surface that is suitable for printing, and it is preferably used in the production of different kinds of packages, e.g. food packages. The board is suitable for use in packaging processes where steam is used for sterilisation of the package and/or the food, e.g. co-sterilization of the package and its contents.

BACKGROUND

In the field of package production there is a demand for good printability of the paperboard. Good printing surfaces are normally created by clay-coating of the board surface. The board for packages is usually a multiply board with a bleached top layer under the clay coating. The term clay coating covers all types of coatings where pigments and binders are used together; However, clay-coated board is much more sensitive to water penetration during and after the sterilisation with steam than uncoated board. Therefore, clay-coated board is not at all suitable for production of packages that will be sterilized with steam.

The printing surface is the top layer of the board made of bleached cellulosic fibres. An improved top layer can be achieved if the board web is compressed in one or more roll nips, in most cases after the drying, in a calendering operation. An improved top layer can also be achieved by coating of the board with a coating colour, consisting of pigments and binders. In some applications of board for packaging of food it is a disadvantage to have a coating colour on the board surface, as the coating colour can reduce the hydrofobicity of the board. This is especially notable if steam is used for sterilisation of the board.

A recently developed extended soft nip calendering technique with substantially higher calendering temperature than normally used is disclosed in WO 01/29316. This technique can be used to provide a desired printing surface with low surface roughness, high gloss, and minimal gloss variation to uncoated paperboard, enabling the paperboard to be used in the production of printed packages. The roll temperature can be above 250° C. in the disclosed a extended soft nip calender. The top layer surface of the produced paperboard is resembles a coated rather than an uncoated product. In this context it can be mentioned that the extended soft nip calendering technique has previously been used to reduce the density of coated liquid board (WO 96/28609).

Further, there, is a newly developed process for packaging of wet food in packages made of laminated board, similar to the process of packaging food in tin cans. In this process the package and the food in it are sterilized together (U.S. Pat. No. 6,177,048). Steam is used for the sterilization, similarly to the production of canned food. If there are cut board edges on the package, steam and water will penetrate into the board through the cut edges. As the diffusion of water vapour cannot be prevented, steam will penetrate into the board through the edges and condensate. As the fibre surfaces become wet due to the condensation of the water vapour they will loose their hydrophobic character and water penetration due to capillary forces will occur. When this happens, the board gets soaked with water in a relatively short time.

In the field of packaging of liquid and/or wet food the board is often laminated with polyethylene or other plastic materials. The board must resist different sterilisation treatments, e.g. sterilisation with hydrogen peroxide. Edge-wicking (edge-soaking) at the cut and uncovered board edges is a particularly difficult problem. Resistance against edge-wicking is normally created by the use of different sizing agents, such as AKD (alkyl ketene dimer), rosin size and ASA (alkenyl succinic anhydride). The sizing agents can be used one alone or in combinations with each other, the combination of AKD and rosin size, known as dual sizing, being the generally accepted combination for liquid packaging board. The sizing agents are retained on the fibres during the paper making process and they spread over the fibre surfaces during the drying operation due to melting. Thereby the fibre surfaces will become hydrophobic and water penetration in the fibre structure of the board due to capillary forces is prevented. The general belief among scientists is that only a fraction of the fibre surfaces need to be covered in order to achieve a good hydrofobicity. Normally the AKD is based on stearic acid (C18) but palmitic acid (C16) or mixtures of C16 and C18 are also possible. However, according to accepted theory, the diffusion of water vapour into the board cannot be prevented by sizing.

It is well known [Roberts J. (1997): "A rewiew of advances in internal sizing", Proc. The $11^{th}$ Fundamental Research Symposium in Cambridge, pp 209-263] that maximum resistance against water penetration due to capillary forces is reached at relatively low addition levels of sizing agent, i.e. with 0.015% (0.15 kg/ton) reacted AKD in the sheet. All the added AKD is not retained in the sheet and all the retained AKD will probably not react. Experience has shown that addition levels of 2 kg of AKD per ton of dry fibres gives a sufficient margin in order to achieve the maximum hydrofobicity possible and necessary in the production of liquid packaging board. An addition of rosin size, between 1 and 1.5 kg/ton, is believed to improve the resistance against hydrogen peroxide, but it does not improve the hydrofobicity as such.

The pore structure is of great importance for water penetration into paper and board. The Washburn equation describes penetration of liquids into parallel capillaries, but it is also used to give an approximate description of water penetration into paper and board. In order to minimize water penetration according to the Washburn equation, the fibre surfaces should have as low surface energy as possible (i.e. maximum hydrofobicity) and the pore radii should be as small as possible. Small pores are created by relatively intensive beating of the fibres in refiners and/or by wet pressing of the wet board web with high pressure in the press section of the paper machine. When creating the small pores by beating and/or wet pressing, density of the board will increase. Therefore, high density of the paperboard reflects small pore sizes.

It would thus be desirable to be able to produce uncoated paperboard for packages with superior resistance against water penetration enabling water vapour sterilization of the package. As good printability is important for high quality packages of today, it would be desirable to be able to produce the board with a printing surface that is comparable to clay-coated board without compromising with other quality requirements of the product.

DESCRIPTION OF THE INVENTION

The present invention provides an uncoated paperboard for packages with a superior resistance against water penetration, especially if the board is treated with steam in a sterilisation process, and a top layer of bleached kraft pulp and with a good surface for printing without compromising with other quality requirements.

The uncoated paperboard for packages according to the invention is obtainable by a paper making process wherein an adequate amount of sizing agent, such as AKD, is used in the production of normal liquid packaging board. The relatively high density required is achieved by intensive beating and/or wet pressing. The possible problems with cracks caused by the high density may be avoided to some extent by treating the fibres in a HC refiner. The good printing surface, which is comparable to clay-coated surfaces, is obtained e.g. by an extended soft nip (also named long nip) calendering technique with substantially higher calendering temperature than normally used (Cf. WO 01/29316).

The required hydrofobicity may be achieved by relatively high or considerably higher dosages of AKD-size than in the production of normal liquid packaging board, i.e. between 2 and 4 kg/ton dry fibres. A considerably higher density of the paperboard, 700 to 850 kg/m$^3$, a result of the desire to have smaller pores in the board than in normal liquid packaging board, is an important part of the concept for achievement of adequate or maximum hydrofobicity.

The pulp, all or a part of it, may be treated in a HC refiner in order to make the fibres more flexible and thereby providing a fexibility to the board, intended to reduce the possible problems with cracks that are caused by the, high density of the board. HC refining is a common fibre treatment in the production of sack paper.

The good printing surface can be obtained by a new calendering technique, the extended soft nip (or the long nip calender), that has been brought into production scale, where the advantages of soft calendering has been further developed (Cf. WO 01/29316). Compared to conventional soft nips, the local stress concentrations in the calender nip is substantially reduced with the extended soft nip. The required smoothening of the paper surface can therefore be obtained with a minor or none increase of the local variations of the surface properties when coated paper webs are calendered. The calendering of the paper or board is performed with an extended soft nip calender which has a heated roll pressing against the top layer of the paper or board and has a surface temperature of 250 to 350° C., and the pressure against the paper board is adjusted to 5-40 MPa depending on the line load, the properties of the calender belt and the length of the extended soft nip.

Thus, one aspect of the invention is directed to uncoated paperboard for packages composed of one or more layers with a top layer of bleached kraft pulp having a gloss value of 15-50% measured according to Tappi T480, a minimal gloss variation (a coefficient of variation in the wavelength regions 3-30 mm of less than 5%), and a surface roughness (PPS-10) of 2-5 μm measured according to ISO 8791-4, wherein the paperboard has a density in the range of 700 to 850 kg/m$^3$ and is hydrophobic from a sizing agent treatment of each layer. The coefficient of gloss variation may be measured by a method described by Bryntse and Norman. [Bryntse G. and Norman B. (1976): "A method to measure variations in surface and diffuse reflectance of printed and unprinted samples", Tappi, 59:4, 102.]

In a preferred embodiment of the invention the paperboard is a liquid packaging board, and in another embodiment the sizing agent treatment of each layer involved the use of a dosage of sizing agent in the range of 2 and 4 kg/ton dry fibres. The sizing agent is preferably a commercially available AKD, such as C18-based AKD (alkyl ketene dimer).

In yet another embodiment of the invention at least a portion of the fibres of the board has been treated with a HC (high consistency) refiner.

Another aspect of the invention is directed to a package comprising an uncoated paperboard according to the invention.

A further aspect of the invention is directed to the use of a package according to the invention for co-sterilization of the package and its contents. The sterilization technique preferably comprises a step involving water vapour.

The invention will now be illustrated by the description of embodiments, but it should be understood that these embodiments do not limit the scope of protection defined in the claims.

DESCRIPTION OF EMBODIMENTS

The uncoated paperboard of the invention may be produced as a two layer (duplex) board with a top layer of bleached sulphate pulp, a mixture of 50% softwood and 50% hardwood pulp, and a bottom layer of unbleached softwood pulp. A part of the unbleached softwood pulp, e.g. 50%, can be treated in a HC refiner in order to increase the flexibility of the fibres, which is believed to decrease the tendency for cracks in the converting of the board. The level of beating of all three pulps should be at least 21° SR.

The dosage of sizing agent, in this case a C18-based AKD-size, should be at least 2 kg/ton and is preferably between 3 kg/ton and 4 kg/ton, the higher limit being the upper limit accepted by the authorities for food packaging material. The AKD is added as a commercial emulsion to the furnish according to some generally accepted principle. pH in the furnish should preferably be higher than 6.5, and most preferably between 7.1 and 8.0. A retention aid may be used, preferably cationic starch in combination with an anionic silica sol. Bicarbonate is known to improve AKD sizing and should therefore preferably be added. Small amounts of alum might also be added to the furnish.

The smooth upper surface of the board can be achieved by the use of an extended soft nip calender wherein the metal roll can be heated to more than 250° C. according to the technique disclosed in WO 01/29316.

The paperboard of the invention has been produced in the paper mill, and the following properties have been analyzed from three separate runs:

| | Minimum | Maximum |
|---|---|---|
| Grammage (ISO 536:1995) | 238.1 | 247.7 |
| Thickness (ISO 534:1988) | 299 | 340 |
| Density (ISO 534:1988) | 724 | 808 |
| PPS10, top side (ISO 8791-4:1992) | 2 | 5 |
| Moisture content (ISO 287:1985) | 7.1 | 9.6 |

The invention claimed is:

1. An uncoated, steam sterilizable paperboard composed of two or more layers with a top layer of bleached kraft pulp having a gloss value of 15 - 50% measured according to Tappi T480, a coefficient of gloss variation in the wavelength regions 3-30 mm of less than 5%, and a surface roughness PPS-10 of 2-5 μm measured according to ISO 8791-4, wherein the paperboard has a density in the range of 700 to 850 kg/m$^3$ and is hydrophobic from a sizing agent treatment of each layer at a dosage of sizing agent in the range of 2 to 4 kg/ton dry fibres.

2. The uncoated paperboard according to claim 1, wherein the paperboard is a liquid packaging board.

3. The uncoated paperboard according to claim 2, wherein the sizing agent treatment of each layer is at a dosage of sizing agent in the range of 3 to 4 kg/ton dry fibres.

4. The uncoated paperboard according to claim 2, wherein at least a portion of the fibres of the board is HC (high consistency) refiner-treated fibers.

5. A steam sterilized package comprising an uncoated paperboard according to claim 2.

6. The uncoated paperboard according to claim 1, wherein the sizing agent treatment of each layer is at a dosage of sizing agent in the range of 3 to 4 kg/ton dry fibres.

7. The uncoated paperboard according to claim 6, wherein the sizing agent is C18-based AKD (alkyl ketene dimer).

8. The uncoated paperboard according to claim 7, wherein at least a portion of the fibres of the board is HC (high consistency) refiner-treated fibers.

9. A steam sterilized package comprising an uncoated paperboard according to claim 7.

10. The uncoated paperboard according to claim 6, wherein at least a portion of the fibres of the board is HC (high consistency) refiner-treated fibers.

11. A steam sterilized package comprising an uncoated paperboard according to claim 6.

12. The uncoated paperboard according to claim 1, wherein at least a portion of the fibres of the board is HC (high consistency) refiner-treated fibers.

13. The uncoated paperboard according to claim 12, wherein at least a portion of the fibres of the board is HC (high consistency) refiner-treated fibers.

14. A steam sterilized package comprising an uncoated paperboard according to claim 12.

15. A steam sterilized package comprising uncoated paperboard according to claim 1.

16. The steam sterilized package according to claim 15, wherein the package has been co-sterilized with its contents.

17. An uncoated, steam sterilizable paperboard consisting of two layers with a top layer of bleached kraft pulp having a gloss value of 15-50% measured according to Tappi T480, a coefficient of gloss variation in the wavelength regions 3-30 mm of less than 5%, and a surface roughness PPS-10 of 2-5 μm measured according to ISO 8791-4, wherein the paperboard has a density in the range of 700 to 850 kg/m$^3$ and is hydrophobic from a sizing agent treatment of each layer at a dosage of sizing agent in the range of 2 to 4 kg/ton dry fibres.

18. A steam sterilized package comprising the uncoated paperboard according to claim 17.

19. The steam sterilized package according to claim 18, wherein the package has been co-sterilized with its contents.

* * * * *

UNITED STATES PATENT AND TRADEMARK OFFICE

CERTIFICATE OF CORRECTION

PATENT NO. : 7,628,885 B2
APPLICATION NO. : 10/486367
DATED : December 8, 2009
INVENTOR(S) : Hübinette et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 946 days.

Signed and Sealed this

Twenty-first Day of December, 2010

David J. Kappos

David J. Kappos
*Director of the United States Patent and Trademark Office*